US008020678B2

(12) United States Patent
Tsai et al.

(10) Patent No.: US 8,020,678 B2
(45) Date of Patent: Sep. 20, 2011

(54) TRAVELING CASE WITH A FOOT STAND ASSEMBLY

(76) Inventors: Ming-Chu Tsai, Jhonghe (TW); Chun-Te Chen, Jhonghe (TW)

( * ) Notice: Subject to any disclaimer, the term of this patent is extended or adjusted under 35 U.S.C. 154(b) by 355 days.

(21) Appl. No.: 12/361,251

(22) Filed: Jan. 28, 2009

(65) Prior Publication Data

US 2010/0163358 A1 Jul. 1, 2010

(30) Foreign Application Priority Data

Dec. 31, 2008 (TW) ..... 97223720 U

(51) Int. Cl.
*A45C 5/14* (2006.01)

(52) U.S. Cl. ..... 190/18 A; 190/115

(58) Field of Classification Search ..... 190/18 A, 190/39, 115
See application file for complete search history.

(56) References Cited

U.S. PATENT DOCUMENTS

| | | | | |
|---|---|---|---|---|
| 1,081,221 | A * | 12/1913 | Durkin | 280/641 |
| 2,598,168 | A * | 5/1952 | Hooz et al. | 280/641 |
| 5,519,919 | A * | 5/1996 | Lee | 16/113.1 |
| 5,568,848 | A * | 10/1996 | Liang | 190/18 A |
| 6,082,510 | A * | 7/2000 | Liang | 190/18 A |
| 6,182,981 | B1 * | 2/2001 | Kuo | 280/37 |
| 6,279,705 | B1 * | 8/2001 | Wu | 190/18 A |
| 6,345,414 | B1 * | 2/2002 | Chen | 16/113.1 |
| 6,454,065 | B1 * | 9/2002 | Chen | 190/18 A |
| 6,802,409 | B1 * | 10/2004 | Tiramani et al. | 190/18 A |
| 2004/0069583 | A1 | 4/2004 | Tamura | |
| 2005/0023096 | A1 | 2/2005 | Tiramani | |
| 2008/0135366 | A1 * | 6/2008 | Katz et al. | 190/18 A |
| 2008/0223679 | A1 * | 9/2008 | Wong | 190/18 A |
| 2008/0272563 | A1 | 11/2008 | Tsai et al. | |

FOREIGN PATENT DOCUMENTS

| | | | |
|---|---|---|---|
| DE | 29720642 | U1 | 2/1998 |
| FR | 2905657 | A1 | 3/2008 |

OTHER PUBLICATIONS

European Patent Office Search Report for European Patent Application No. 09009650.4, dated Jun. 11, 2010.

* cited by examiner

*Primary Examiner* — Sue Weaver
(74) *Attorney, Agent, or Firm* — C. G. Mersereau; Nikolai & Mersereau, P.A.

(57) ABSTRACT

A traveling case has a container and a foot stand assembly. The container has a top, a bottom, a rear, a handle, multiple wheels and a foot stand recess. The handle is mounted on the top of the container. The wheels are pivotally mounted on the bottom of the container. The foot stand recess is mounted on the rear of the container. The foot stand assembly is mounted on the rear of the container and has a foot stand and a telescopic strut. Therefore, when the traveling case is loaded, a carrier is not required to stabilize the traveling case in order to avoid the traveling case toppling. Therefore, the traveling case is convenient.

1 Claim, 7 Drawing Sheets

TRAVELING CASE WITH A FOOT STAND ASSEMBLY

BACKGROUND OF THE INVENTION

1. Field of the Invention

The present invention relates to a traveling case, especially to be a traveling case that has a folding frame and can assist a carrier with moving the traveling case.

2. Description of the Prior Arts

Most traveling cases are used during travels in order to carry luggage. The traveling case in accordance with the prior art has a bottom, a back, four wheels and a pulling bar. The wheels are respectively attached to corners of the bottom of the traveling case in order to facilitate moving the traveling case. The pulling bar is mounted on the back of the traveling case to aid holding the traveling case. When the traveling case is moved, the traveling case is inclined relative to the ground so two wheels of the traveling case move over the ground.

However, when the weight of the traveling case is high, the traveling case is easily toppled so travelers have to use a force to stabilize the traveling case in order to avoid the traveling case toppling, thereby limiting a weight that may be carried and reducing convenience of use.

To overcome the shortcomings, the present invention provides a to mitigate or obviate the aforementioned problems.

SUMMARY OF THE INVENTION

The main objective of the present invention is to provide a traveling case that has a folding frame to assist moving the traveling case.

A traveling case in accordance with the present invention comprises a container and a foot stand assembly. The container has a top, a bottom, a rear, a handle, multiple wheels and a foot stand recess. The handle is mounted on the top of the container. The wheels are pivotally mounted on the bottom of the container. The foot stand recess is mounted on the rear of the container. The foot stand assembly is mounted on the rear of the container and has a foot stand and a telescopic strut. When the traveling case is loaded, a carrier is not required to stabilize the traveling case in order to avoid the traveling case toppling. Therefore, the traveling case is convenient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
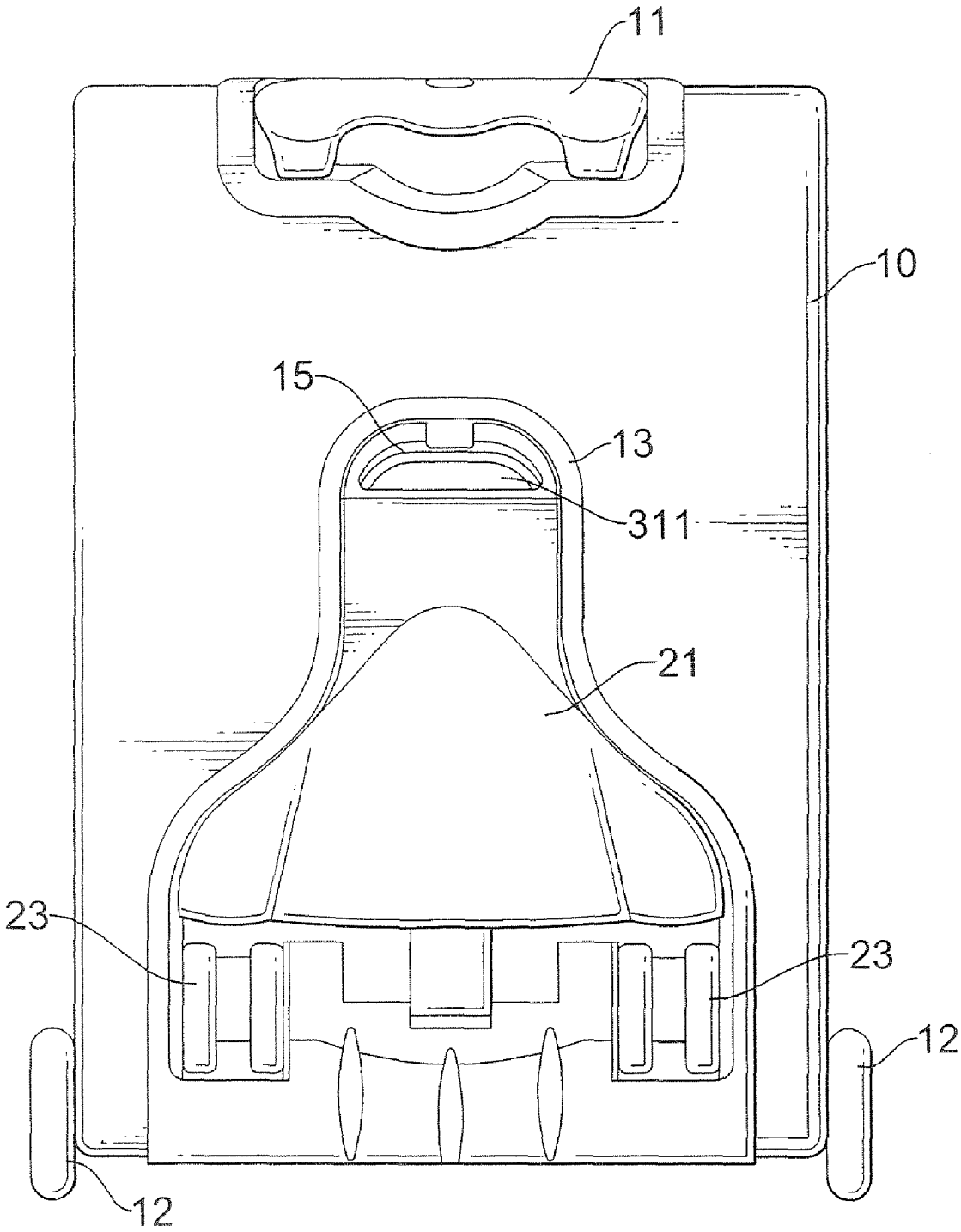
FIG. 1 is a rear view of a traveling case in accordance with the present invention.
Figure 2:
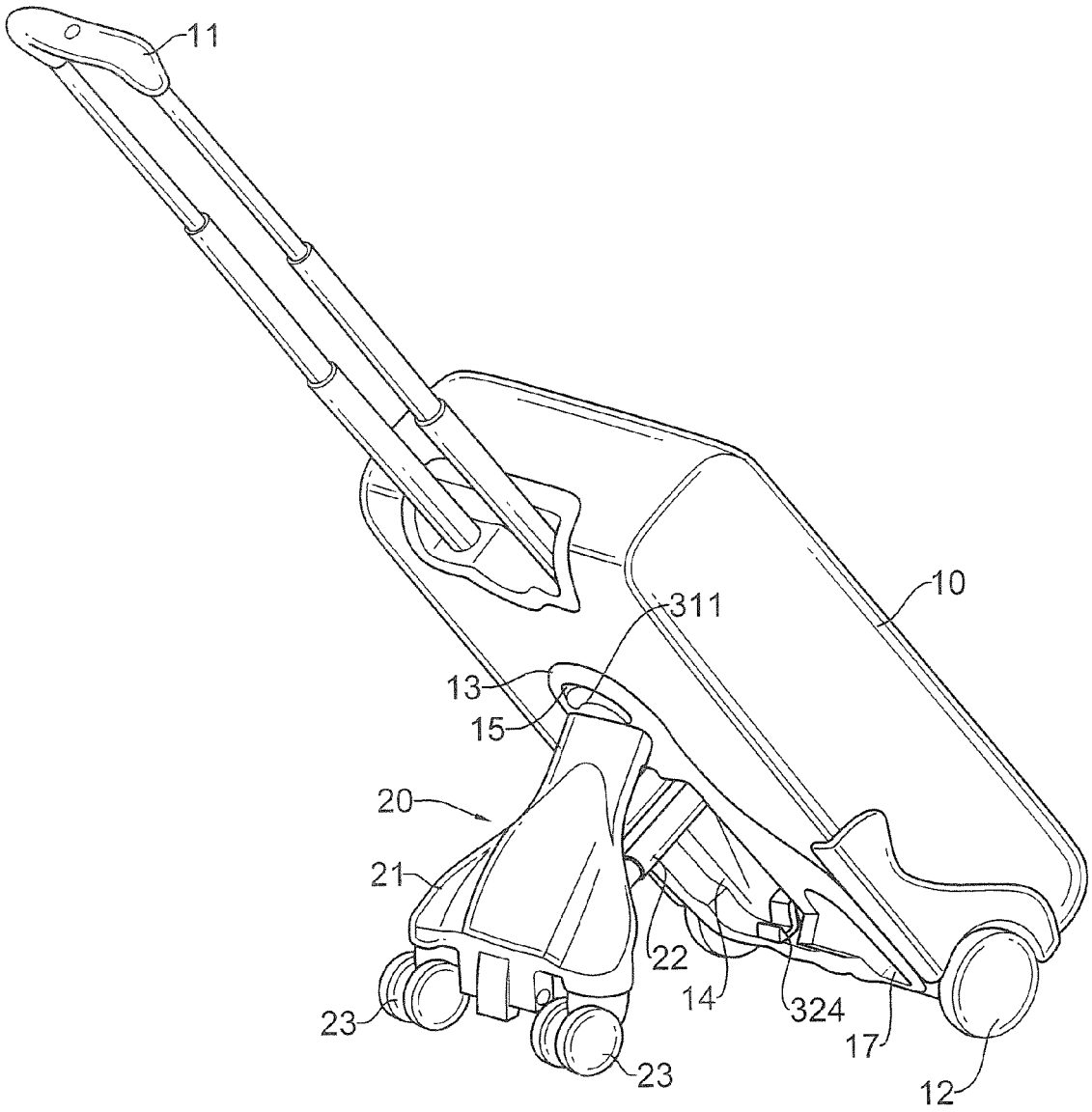
FIG. 2 is a perspective view of the traveling case in FIG. 1 shown with a foot stand assembly open.
Figure 3:
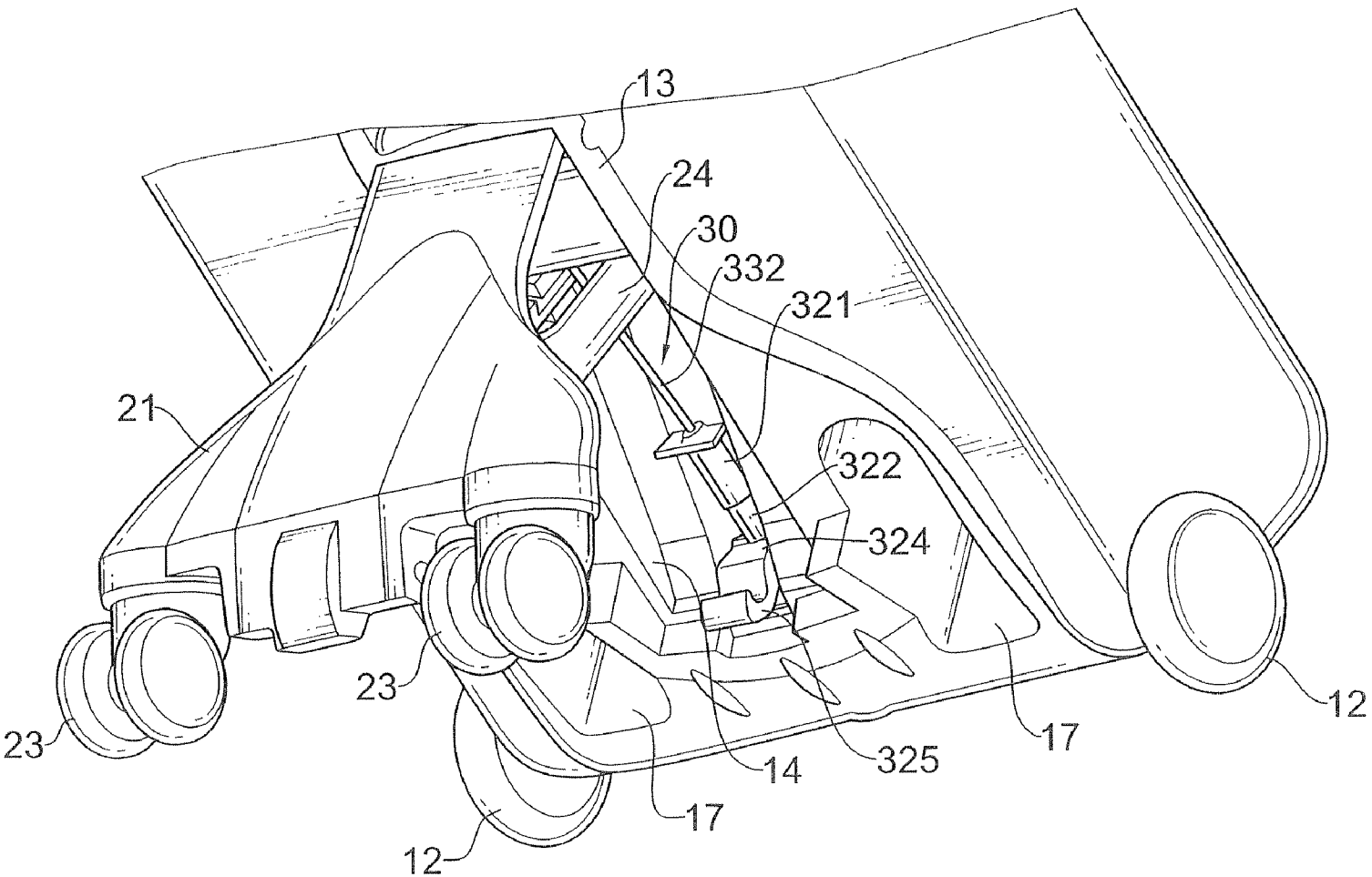
FIG. 3 is an enlarged perspective view of the traveling case in FIG. 1.

With reference to FIGS. 1 to 3, a traveling case in accordance with the present invention comprises a container (10), a foot stand assembly (20) and a buckling device (30).

Figure 6:
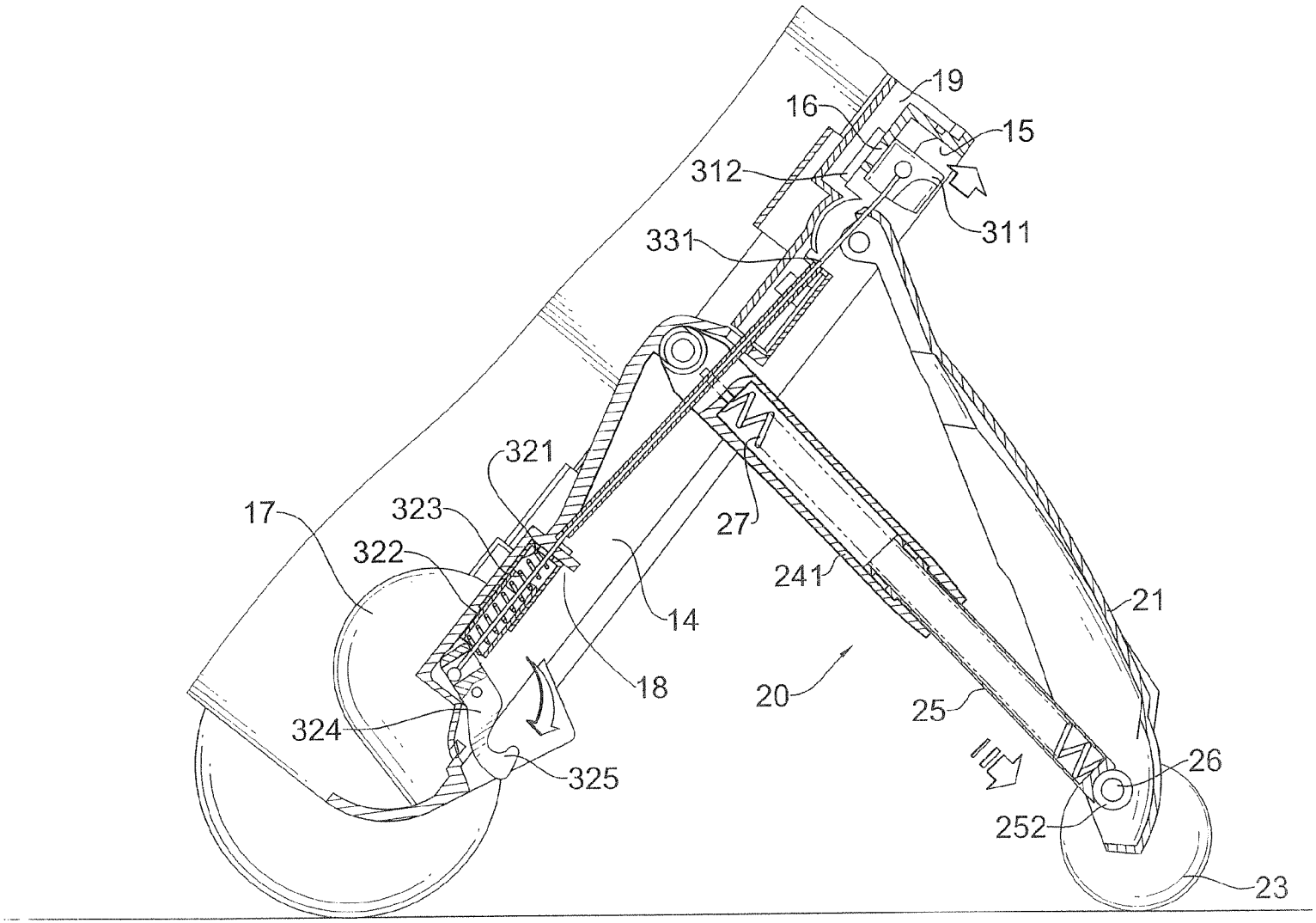
FIG. 6 is a side view in partial section of the traveling case in FIG. 1 shown with the foot stand assembly open.

With further reference to FIG. 6, the container (10) has a chamber (19), a top, a bottom, a rear, a handle (11), multiple wheels (12) and a foot stand recess (13).

The handle (11) is mounted on the top of the container (10).

The wheels (12) are rotatably mounted on the bottom of the container (10).

The foot stand recess (13) is mounted on the rear of the container (10) and has a top, two sides, a containing cavity (14), a depression (15), a through hole (16), two holding troughs (17) and a fastening channel (18).

The depression (15) is formed in the top of the foot stand recess (13). The through hole (16) is formed in the top of the foot stand recess (13) and has two ends. One end of the through hole (16) communicates with the containing cavity (14). The other one end of the through hole (16) communicates with the chamber (19) of the container (10). The holding troughs (17) are respectively formed at two sides of the foot stand recess (13). The fastening channel (18) is formed between the holding trough (17) of the foot stand recess (13) and communicates with the containing cavity (14) of the foot stand recess (13).

The foot stand assembly (20) is mounted on the rear of the container (10) and has a foot stand (21) and a telescopic strut (22).

The foot stand (21) is mounted on the containing cavity (14) of the foot stand recess (13) and has a top, a bottom, two sides and at least one rolling wheel (23). The top of the foot stand (21) is pivotally mounted on the foot stand recess (13). The at least one rolling wheel (23) is rotatably mounted on the bottom of the foot stand (21). Two rolling wheels (23) may be implemented and rotatably mounted on the bottom of the foot stand (21) and respectively adjacent to two sides of the foot stand (21).

Figure 4:
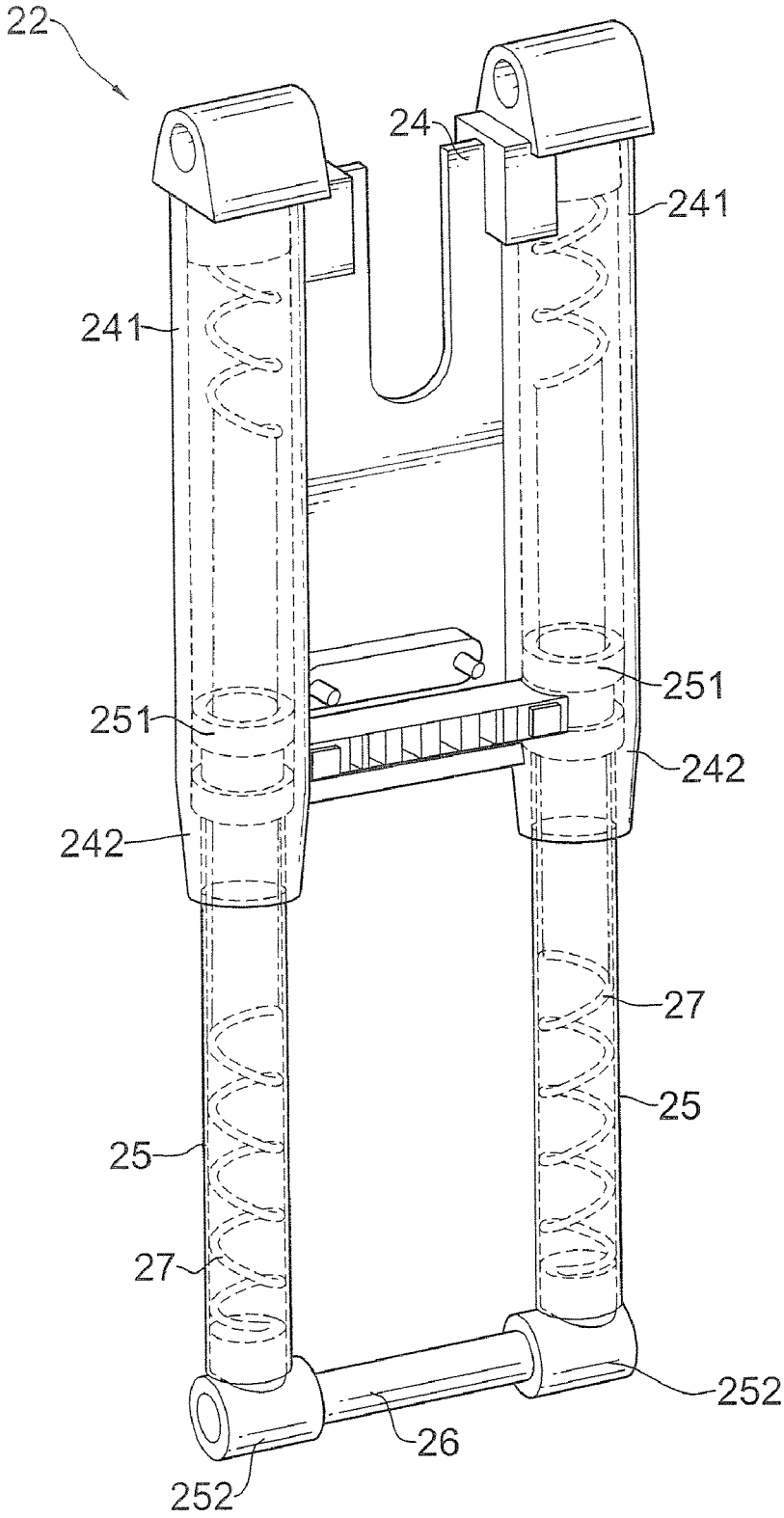
FIG. 4 is a perspective view of a telescopic strut of the traveling case in FIG. 1.

With further reference to FIG. 4, the telescopic strut (22) of the foot stand assembly (20) is pivotally and telescopically mounted between the container (10) and the foot stand (21) and has a first support (24), two second supports (25), a pivot (26) and two springs (27).

The first support (24) has two sides and two first sleeves (241). The first sleeves (241) are respectively formed on the two sides of the first support (24) and each first sleeve (241) has a top end, a bottom end and a neck (242). The top end of the first sleeve (241) is pivotally mounted on the container (10) and is located between the top of the foot stand (21) and the bottom of the container (10). The neck (242) is formed on the bottom end of the first sleeve (241) and may be narrower than the first sleeve (241). In an alternate embodiment, the top end of the first sleeve (241) is pivotally mounted on the foot stand recess (13).

The second supports (25) are respectively mounted telescopically in the two first sleeves (241) of the first support (24) and each second support (25) has a top end, a bottom end, a head (251) and a pivot mount (252). The head (251) is formed on the top end of the second support (25) and selectively abuts the neck (242) of the first support (24) to limit extension of the telescopic strut (22). The pivot mount (252) is transversely formed on and connects the bottom ends of the second supports (25).

The pivot (26) is transversely mounted through the pivot mounts (252) of two second supports (25) and is rotatably mounted on the bottom of the foot stand (21).

The springs (27) are respectively mounted in the first sleeves (241) and respectively bias the second supports (25) out from the first sleeves (241).

Figure 5:
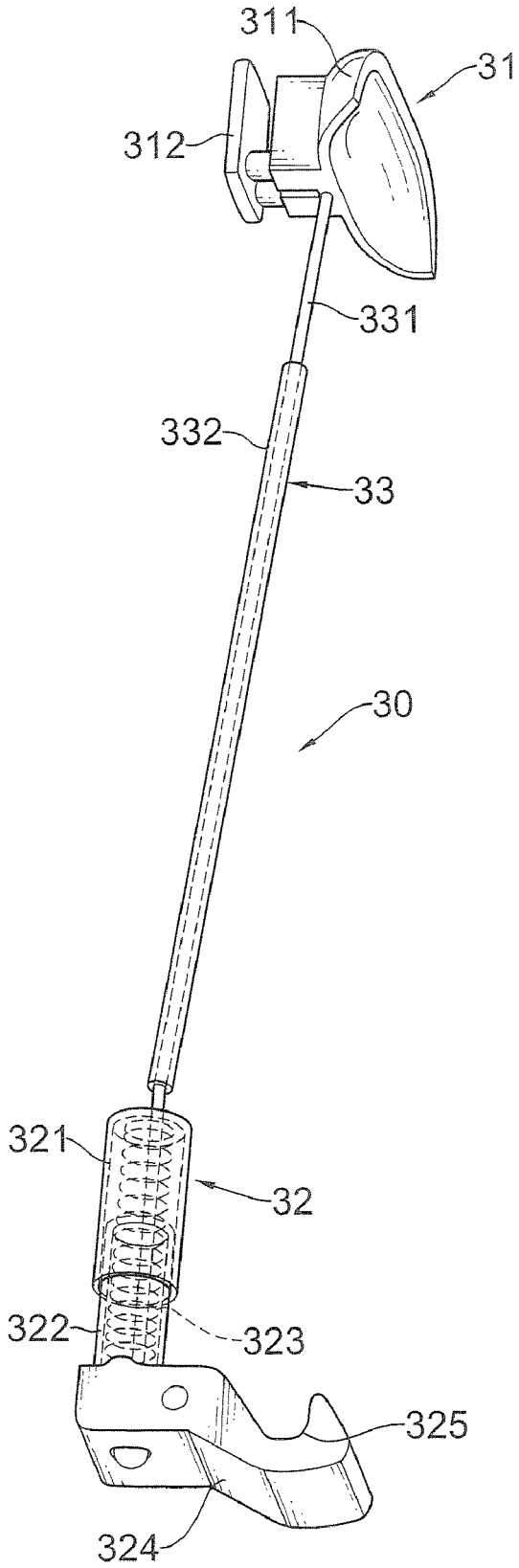
FIG. 5 is a perspective view of a buckling device of the traveling case in FIG. 1.

With further reference to FIG. 5, the buckling device (30) has a lever (31), a buckling element (32) and an attaching assembly (33).

The lever (31) is mounted on the depression (15) of the foot stand recess (13) and has a moving handle (311) and a guiding protrusion (312). The moving handle (311) is movably mounted in the depression (15) of the foot stand recess (13). The guiding protrusion (312) is formed on and protrudes from the moving handle (311) and is mounted through the through hole (16) of the foot stand recess (13) and movably in the depression (15) of the foot stand recess (13).

The buckling element (32) is mounted in the fastening channel (18) of the foot stand recess (13) and has a first connecting sleeve (321), a second connecting sleeve (322), a contacting spring (323) and a hook (324).

The second connecting sleeve (322) is mounted on the first connecting sleeve (321) and has a bottom. The contacting spring (323) is mounted between the second connecting sleeve (322) and the first connecting sleeve (321) to offer a resilient force between the second connecting sleeve (322) and the first connecting sleeve (321). The hook (324) is mounted on the bottom of the second connecting sleeve (322), is pivotally mounted on the foot stand recess (13) and has a barb (325). The barb (325) is detachably engaged with the pivot (26) of the telescopic strut (22) to fasten the foot stand assembly (20) on the containing cavity (14) of the foot stand recess (13).

The attaching assembly (33) is attached between the lever (31) and the buckling element (32) and has an attaching wire (331) and a protecting sleeve (332). The attaching wire (331) is attached between the moving handle (311) of the lever (31) and the hook (324) of the buckling element (32) and is mounted through the first connecting sleeve (321), the second connecting sleeve (322) and the contacting spring (323). The protecting sleeve (332) is mounted around the attaching wire (331) to protect the attaching wire (331) from damage.

With further reference to FIG. 6, when the traveling case is to be moved, the lever (31) is pulled to actuate the buckling device (30) to compress the contacting spring (323) between the second connecting sleeve (322) and the first connecting sleeve (321) and move pivotally the hook (324). Then, the barb (325) of the hook (324) can loosen on the pivot (26). Therefore, the telescopic strut (22) pushes the foot stand (21) of the foot stand assembly (20) toward the rear of the container (10) and the at least one rolling wheel (23) touches the ground in order to facilitate the user moving the traveling case.

Figure 7:
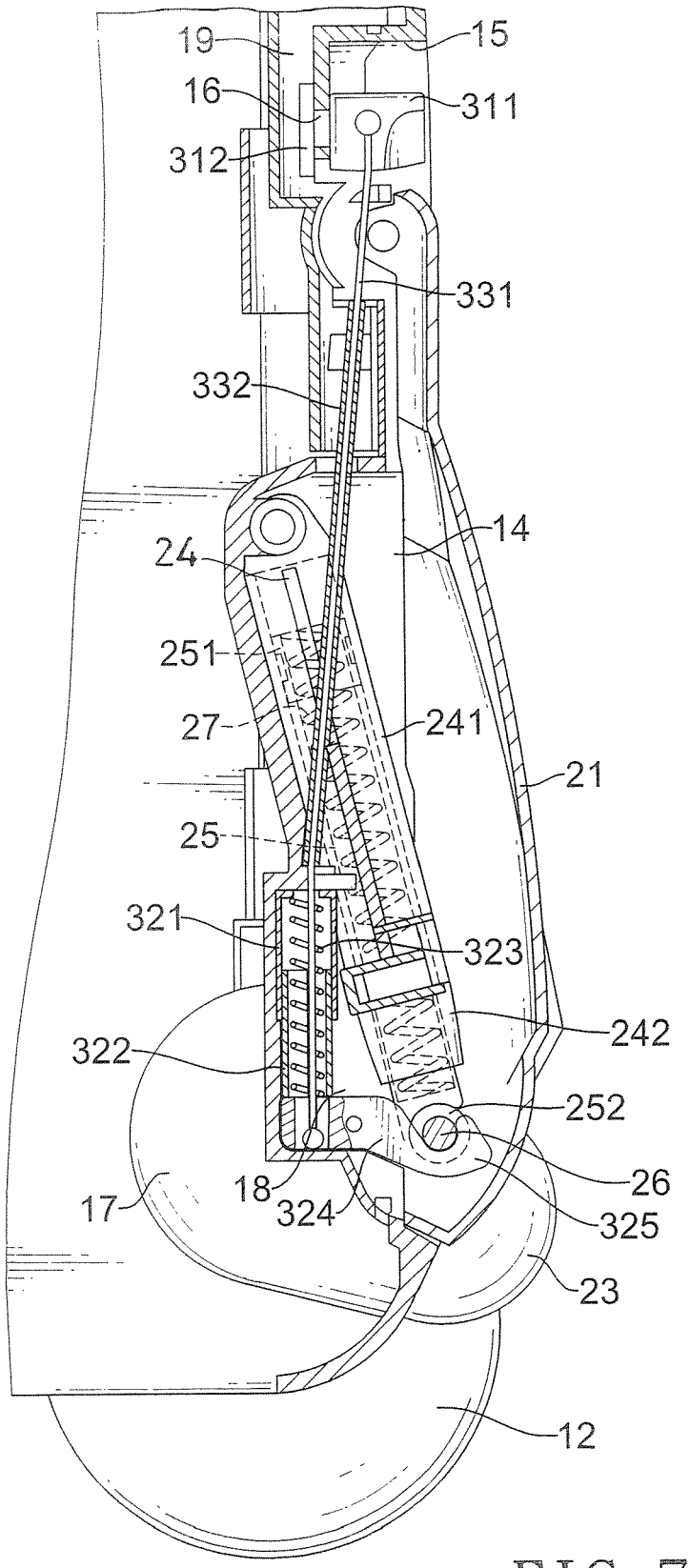
FIG. 7 is a side view in partial section of the traveling case in FIG. 1 shown with the foot stand assembly closed.

With further reference to FIG. 7, the traveling case is stored, the foot stand (21) is pressed into the foot stand recess (13) in order to make the barb (325) of the hook (324) of the buckling element (32) hook the pivot (26) of the foot stand assembly (20). Therefore, the traveling case can decrease volume of the full-length traveling case in order to be put easily in place. Thus, the traveling case can be loaded without requiring a balancing force to stabilize the traveling case in order to avoid the traveling case toppling. Therefore, the traveling case is convenient to use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A traveling case comprising a container having
- a top;
- a bottom;
- a rear;
- a handle being mounted on the top of the container;
- multiple wheels being pivotally mounted on the bottom of the container; and
- a foot stand recess being mounted on the rear of the container and having
  - a top;
  - two sides;
  - a containing cavity; and
  - two holding troughs being respectively formed on two sides of the foot stand recess; and a foot stand assembly being mounted on the rear of the container and having
- a foot stand having
  - a top being pivotally mounted on the foot stand recess;
  - a bottom;
  - two sides;
  - at least one rolling wheel being rotatably mounted on the bottom of the foot stand; and
- a telescopic strut being pivotally and telescopically mounted between the container and the foot stand and having
  - a first support having
    - two sides; and
    - two first sleeves being respectively formed on the two sides of the first support and each first sleeve having a top end pivotally mounted on the foot stand recess of the container, a bottom end and a neck being formed on the bottom end of the first sleeve, and wherein the top of each first sleeve is pivotally mounted on the foot stand recess;
  - two second supports being respectively mounted on the two first sleeves of the first support and each second support having
    - a top end;
    - a bottom end;
    - a head being formed on the top end of the second support; and
    - a pivot mount being transversely formed on the bottom end of the second support;
  - a pivot being transversely mounted through the pivot mounts of the two second supports and rotatably mounted on the foot stand; and
  - two springs being respectively mounted in the first sleeves and respectively biasing the second supports out from the first sleeves;

wherein the foot stand recess of the container further has
- a depression being formed in the top of the foot stand recess;
- a through hole being formed in the top of the foot stand recess and having two ends, one end of the through holes communicating with the containing cavity, the other one end of the through hole communicating with a chamber of the container;
- a fastening channel being formed between the two holding troughs of the foot stand recess and communicating with the containing cavity of the foot stand recess; and wherein the traveling case further has a buckling device having a lever being mounted on the depression of the foot stand recess and having a moving handle being movably mounted on the depression of the foot stand recess; and a guiding protrusion being formed on and protruding from the moving handle and being mounted through the through hole of the foot stand recess;

a buckling element being mounted in the fastening channel of the foot stand recess and having a first connecting sleeve;

a second connecting sleeve being mounted on the first connecting sleeve and having a bottom;

a contacting spring being mounted between the second connecting sleeve and the first connecting sleeve; and a hook being mounted on the bottom of the second connecting sleeve, being pivotally mounted on the foot stand recess and having a barb being detachably engaged with the pivot of the telescopic strut; and an attaching assembly being attached between the lever and the buckling element and having an attaching wire being attached between the moving handle of the lever and the hook of the buckling element and being mounted through the first connecting sleeve, the second connecting sleeve and the contacting spring; and a protecting sleeve being mounted around the attaching wire.

* * * * *